United States Patent [19]

Freelander

[11] Patent Number: 5,071,003

[45] Date of Patent: Dec. 10, 1991

[54] FRAMELESS HANGING GARMENT BAG

[75] Inventor: Robert C. Freelander, Long Beach, Calif.

[73] Assignee: Richards Homewares, Inc., Long Beach, Calif.

[21] Appl. No.: 698,792

[22] Filed: May 13, 1991

[51] Int. Cl.[5] ..... B65D 85/18

[52] U.S. Cl. ..... 206/282; 206/289; 206/298; 383/9; 383/22

[58] Field of Search ..... 206/278, 282, 289, 290, 206/291, 298, 806; 383/9, 22, 24, 66

[56] References Cited

U.S. PATENT DOCUMENTS

| | | | |
|---|---|---|---|
| 2,961,091 | 11/1960 | Enrich | 206/290 |
| 3,244,261 | 4/1966 | Herz | 383/24 |
| 4,111,297 | 9/1978 | Paulin | 206/806 |
| 4,140,163 | 2/1979 | Usner | 383/22 |
| 4,244,453 | 1/1981 | Herz | 206/278 |
| 4,693,369 | 9/1987 | Lagin | 206/290 |
| 4,905,826 | 3/1990 | Martin | 206/289 |

FOREIGN PATENT DOCUMENTS

| | | | |
|---|---|---|---|
| 1103054 | 10/1955 | France | 206/290 |
| 86451 | 4/1936 | Sweden | 206/290 |
| 442801 | 2/1936 | United Kingdom | 206/298 |

*Primary Examiner*—Gary E. Elkins

*Attorney, Agent, or Firm*—Charles H. Thomas

[57] ABSTRACT

A flexible garment bag which requires no rigid frame is provided for protecting clothes hanging in a closet. The hanging garment bag of the invention is provided with a pair of longitudinally aligned closet rod apertures near the upper extremities of the opposite end walls and a closure flap extending from one side wall over the top of the garment bag to overlap the opposite side wall of the bag. The flap extends longitudinally between the end walls and spans a rod access opening slot that extends between the closet rod apertures. The closure flap is releasably securable to the opposite side wall so that the garment bag may be raised from beneath and installed with the overlapping flap supported atop a closet rod such that the closet rod supports the garment bag. A T-shaped access opening divides one of the flexible side walls into vertically elongated sections and is provided with a zipper. Fabric hook and loop releasable fastening strips hold the tops of the vertically elongated sections shut.

20 Claims, 5 Drawing Sheets

FRAMELESS HANGING GARMENT BAG

BACKGROUND OF THE INVENTION

1. Field of the Invention

The present invention relates to an improved garment storage bag for protecting clothing hanging from a closet rod within a wardrobe closet.

2. Description of the Prior Art

For many years flexible walled hanging garment bags have been used to store clothing in closets. Such garment bags protect clothing from an accumulation of dust and minimize wrinkling of the clothing. The bags also protect the clothing stored therein from moths and other insects. The release of naphthalene fumes by moth balls within the confined enclosure of a garment bag greatly improves the effectiveness of the garment bags in protecting clothing from moths.

Most flexible walled garment bags are constructed of either fabric or vinyl plastic. Typically, such garment bags are of an elongated, rectangular configuration and employ a stiff internal wire frame to hole the top of the garment bag in a rectangular configuration. The wire frame within the garment bag provides a longitudinally extending rack from which clothes on hangers can be hung. A plurality of longitudinally spaced wire hooks on the wire frame extend up through small openings in the top of the bag and are hung on the closet rod that runs longitudinally between opposite end walls of a closet.

Conventional soft sided garment storage bags of the type described usually hang suspended beneath a closet rod by means of hooks on the wire frame that project upwardly from the bag. In one prior art device of a different design, openings were provided in the end walls of a garment bag so as to pass through the upper portion of the garment bag. However, the device still employed a rigid wire frame.

One significant and recurring problem that occurs with conventional flexible hanging garment bags is that the rigid wire frame within the bag frequently makes holes in the vinyl or fabric enclosing walls of the bag. When garments are placed into or removed from the hanging bag the fabric or plastic covering of the bag sometimes is pulled against the inflexible rigid corners of the frame. As a result, the flexible covering can become torn. This reduces the effectiveness of the garment bag as a shield against dust and moths and also detracts from the appearance of the hanging bag.

Another significant disadvantage of employing a rigid frame within a fabric or plastic bag is that the cost of materials and fabrication is increased in such a composite assembled structure. The increased cost of producing a conventional flexible garment bag which employs a rigid internal frame reduces the extent to which consumers are willing to protect their garments from dust, wrinkles and moths.

SUMMARY OF THE INVENTION

In one broad aspect the present invention may be considered to be a frameless, flexible garment bag defining an enclosure adapted to releasably receive and enclose a portion of closet rod and having a releasably closable clothing access opening therein.

Preferably, the frameless, flexible hanging garment bag of the invention has opposite end walls defining a pair of longitudinally aligned closet rod apertures therein adapted to receive a closet rod, and opposite side walls. The side walls extend longitudinally between the end walls and converge upwardly toward each other at their upper extremities. The side walls terminate at a rod access opening slit that extends longitudinally the entire distance between the end walls and transversely across the structure of the end walls and into the closet rod apertures. At least one of the flexible side walls defines a releasable closure flap that extends across the rod access opening slit to overlap the other of the side walls proximate to the closet rod apertures. Releasable slit closure means are provided on the releasable closure flap and on the other of the side walls for releasably securing the closure flap over the top of the closet rod, across the rod access opening slit and to the other of the side walls. The closet rod apertures are encompassed within the confines of the closet rod access opening slit. The garment bag is thereby adapted to envelop a longitudinal section of a closet rod and hang suspended therefrom.

In order to hold the releasable closure flap at a certain distance above the closet rod where the flap passes over the top of the closet rod, relatively stiff supports are provided at the end walls. It is desirable to ensure that a gap of an inch or more exists between the top of the closet rod and the flap where the flap passes across the top of the closet rod so that hangers may be placed onto and removed from the closet rod without obstruction by the structure of the flap. To this end the closet rod apertures are formed as circular openings in the end walls surrounded by flat annular reinforcing disks or rings on the end walls. These disks may be formed as thickened annular areas of the plastic structure of the end walls surrounding the closet rod apertures. The annular reinforcing disk-shaped areas are split radially by the access opening slit that extends across the structure of the garment bag. These reinforcing areas on the exterior surfaces of the end walls serve to support the upper extremities of the end walls externally, so as to provide a certain clearance of the releasable closure flap above the closet rod.

To further ensure that the necessary clearance exists over the top of the closet rod the frameless garment bag of the invention may also be provided with a pair of interior supports mounted on the closet rod between the end walls. Each of these interior supports is formed as a flat, annular disk having a radial slot therein by means of which it is mounted on the closet rod. The interior supporting disks are relatively stiff structures and are formed of molded plastic. The interior supports may be structurally identical to the split annular disks that are utilized as separators for different sizes of garments displayed on hangers at retail clothing stores.

The interior supporting split disks are loosely mounted on the closet rod for free longitudinal movement therealong. Each of the flat interior annular disks is longitudinally movable into juxtaposition against a selected end wall in longitudinal alignment with a selected one of the circular closet rod openings. In this way the interior disks support the side edges of the releasable closure flap where the closure flap passes over the top of the closet rod. When the outer diameter of the annular interior supporting disks is about three and one-half inches, adequate clearance space is provided above the top of the closet rod for hangers to be placed onto and removed from the closet rod without interference from the structure of the closure flap.

The frameless, flexible hanging garment bag of the invention does not employ a rigid, intermediate frame which is interposed between the flexible walls of the bag and the closet rod. To the contrary, the flexible structure of the hanging bag is configured so that it is supported directly by and hangs suspended from the closet rod. The garment bag thereby derives its strength from the stronger closet rod, not from a weaker intermediate frame. Consequently, garments of considerable weight may be stored within the garment bag of the invention, since the hooks of the hangers upon which clothing is hung rest directly upon the closet rod, and not upon an intermediate frame within the bag.

Another important benefit of the construction the garment storage bag of the invention is that the likelihood of damage to the flexible fabric or plastic of the hanging bag is diminished considerably due to the absence of an interior, rigid framework. also, the cost of fabrication of a flexible garment bag according to the invention is greatly reduced relative to conventional flexible garment bags which employ a rigid frame due to its simplified construction. That is, the preferred embodiment of the invention involves only the flexible encapsulating enclosure formed by the bag itself plus the internal supports.

A further advantage of the frameless, flexible hanging garment bag of the invention is that a bag of a given length will occupy less space within a closet than a conventional hanging garment bag. As previously noted, conventional hanging garment bags require internal, longitudinally extending wire frames which hand from wire hooks that protrude through the top of the bag and hang from the closet rod. There is thus a vertical distance, typically between about four and eight inches, which separates the top of the closet rod and the hooks of the hangers upon which the garmets are hung in the bag. This vertical space is required beneath the closet rod to accommodate the hanging wire frame. As a result, a conventional garment bag will be suspended much closer to the floor of a closet than an improved garment bag of the same length constructed according to the invention. This reduces the required length of the bag and the volume of storage space beneath the garment bag within which shoes and other articles may be stored.

A further advantage of the flexible walled, frameless, hanging garment bag of the invention is that it occupies less longitudinal space on a closet rod, when only partially filled, compared to a partially filled hanging garment bag of conventional construction. A conventional garment bag having a rigid rectangular framework at its top will occupy the same longitudinal distance on a closet rod regardless of whether the garment bag is filled or only partially filled. This is because the rigid framework of a conventional hanging garment bag defines a specific longitudinal distance along a closet rod over which it will extend regardless of extent to which the garment bag is filled. The frameless garment bag of the present invention, on the other hand, has no such internal rigid frame which extends its end walls beyond the limits necessary to accommodate the garments enclosed therewithin. If a garment bag according to the invention is partially filled, it can be longitudinal compressed or collapsed since there is not frame which holds the top of the bag in a longitudinally extended condition. Consequently, more longitudinal space on the closet rod is left free for other storage.

Yet a further advantage of the frameless hanging garment bag of the invention is that it will fit within extremely narrow closets in which conventional garment bags with rigid wire frames cannot be utilized. The garment bag of the invention may be compressed both longitudinally and transversely, relative to the closet rod and will resiliently deform to accommodate virtually any closet configuration. The preferred embodiment of the invention will fit within a closet having a depth of only eleven and one half inches.

In the preferred construction of a frameless, flexible hanging garment bag according to the invention, the bag is comprised of opposite transverse, flexible end walls and opposite flexible side walls extending therebetween. The flexible end walls define longitudinally aligned closet rod apertures near their upper extremities, and the flexible side walls converge toward each other above the level of the longitudinally aligned closet rod apertures. At least one of the flexible side walls defines a releasable closure flap that extends upwardly above the closet rod apertures and over the top of the closet rod to reside in overlapping fashion across the edge of the opposite side wall proximate to the closet rod apertures. The closure flap extends longitudinally to spa the distance between the two end walls. The edge of the opposite side wall and the closure flap are separated by a clothing rod access slot that extends between the longitudinally aligned apertures in the end walls. The closet rod access slot receives a closet rod when the garment bag is moved into position.

Releasable closure means are provided for releasably securing the closure flap over the closet rod and to the opposite side wall. The releasable closure means preferably takes the form of mating strips of fabric hook and loop releasable fasteners of the type sold under the registered trademark Velcro. A hook and loop-type fabric fastener is preferred to snaps or metal clasps because it provides a better seal and thereby renders the frameless hanging garment bag of the invention more mothproof.

Each of the closet rod apertures is preferably formed as a circular opening which is radially intersected by an extremity of the closet rod access slot. The extremities of the closet rod access slot extend transversely across the structures of the end walls between the side wall opposite that bearing the flap and the closet rod apertures. The width of the slot extremities is narrower than the circular openings of the closet apertures.

The closet rod apertures are preferably surrounded by annular disk shaped reinforcing areas on the end walls. These reinforcing areas are integrally formed as thickened areas in the structures of the end walls. Each of these flat, annular reinforcing areas has a radial slit therein formed by an extremity of the closet rod access slot. The reinforcing areas are flexible enough to be resiliently deformed but stiff enough to retain their annular disk-like shape when released. These reinforcing areas served to support the structure of the end walls above the closet rod so as to provide clearance above the closet rod for insertion and removal of hangers.

Preferably also the frameless garment bag of the invention is provided with a pair of interior supports mounted on the closet rod between the end walls. Each of the interior supports is formed as a flat, annular, radially split, stiff, generally C-shaped plastic disk. Each of the interior supporting disks can be flexed somewhat s that its ends adjacent the radial split can be spread apart a distance greater than the diameter of the closet rod to allow the interior supporting disk to be installed on the closet rod. When released, the ends of the disk will spring back into coplanar alignment so that the disk will remain mounted on the closet rod. Each of the interior supporting disks is freely movable longitudinally along the closet rod within the confines of the garment bag. The interior supporting disks are normally moved into abutment against the interior surfaces of the end walls adjacent the thickened reinforcing sections of the end walls that surround the closet rod apertures. These interior supporting disks thereby provide additional support to maintain a clearance from the top closure flap above the closet rod.

In one alternative embodiment the flexible end walls may both be formed with longitudinally extending sleeves at the closet rod apertures therein. The sleeves are split longitudinally by the extremities of the rod access opening slot Preferably also, some form of closure means is provided for releasably closing the longitudinal splits in the sleeves. This closure means may take the form of a draw string, a snap, a velcro fastener, or any other means for snugly cinching the sleeve about the closet rod so as to provide a snug seal against the closet rod. This aids in maintaining a moth proof environment within the garment bag.

The opening through which clothing is inserted and removed from the garment bag is preferably formed as a T-shaped clothing access opening in one of the side walls having longitudinal and vertical components. The longitudinal component of the clothing access opening includes releasable closure means formed of mating strips of flexible material, one of which bears a multiplicity of tiny plastic hooks and the other of which includes a looped pile engagable with the hooks. The vertical component of the access opening may include a releasable fastener of the same type, or a zipper-type closure means.

The frameless hanging garment bag of the invention may either be formed of clear, transparent plastic or it may be formed largely of an opaque plastic or fabric material. If the garment bag is formed primarily of an opaque material, it preferably has a transparent window in the upper portion of the side wall in which the clothing access opening is formed so as to allow a user to visually determine which garments are stored in the garment bag.

The frameless hanging garment bag of the invention may either be designed to hang from a wooden or metal clothing rod that extends the length of a closet. Such clothing rods are typically formed by wooden dowels or metal pipes ranging in size between about one and one-half inches and three quarter inches in diameter. The size of the circular openings of the closet rod apertures is chosen so as to be only slightly larger than the closet rod in order to isolate the interior of the garment bag from the environment as much as possible. Alternatively, the frameless hanging garment bag of the invention may have closet rod apertures of a considerably smaller size which fit snugly about the much smaller closet rod of a ventilated shelf.

A ventilated shelf is a rack having primary longitudinal supporting rods atop which narrower, transverse rods are secured to form an open shelf. The longitudinally extending closet rod of a ventilated shelf is typically about three eighths of an inch in diameter, and is held beneath the primary supporting rods and parallel thereto by periodically spaced depending struts or support members. Frameless hanging garment bags designed for use with ventilated shelve typically have closet rod apertures formed by circular openings only about three eighths to one-half of an inch in diameter.

The invention may be described with greater clarity and particularity with reference to the accompanying drawings.

DESCRIPTION OF THE EMBODIMENT

Figure 1:
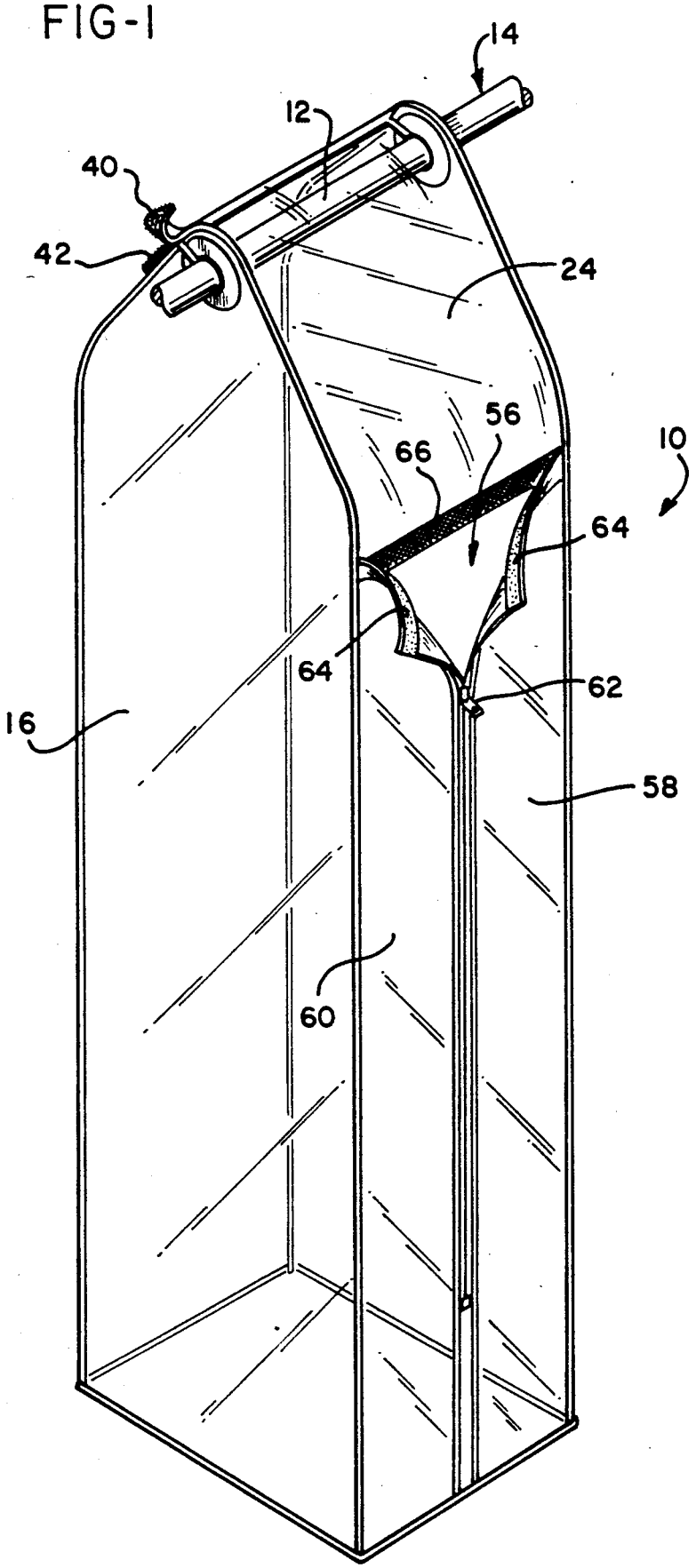
FIG. 1 is a perspective view from the front illustrating one embodiment of a flexible walled frameless garment bag according to the invention.
Figure 4:
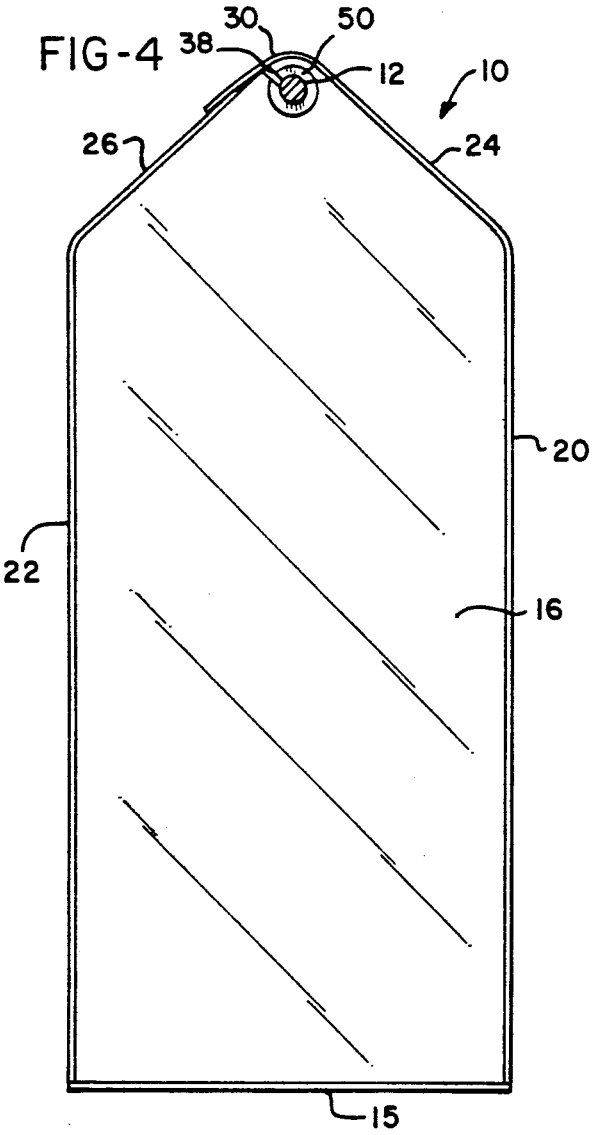
FIG. 4 is an end elevational view taken along the lines 4—4 of FIG. 3.
Figure 5:
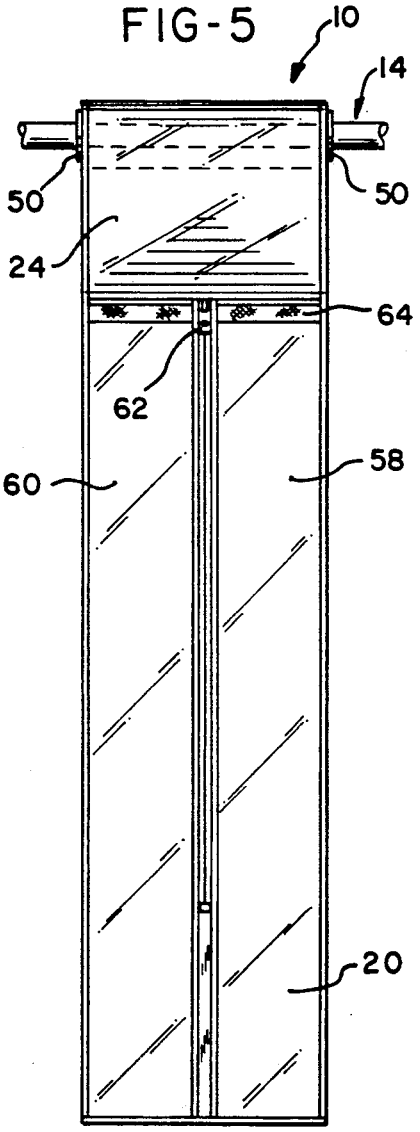
FIG. 5 is a front side elevational view of the garment bag taken along the lines 5—5 of FIG. 3.

FIG. 1 illustrates a flexible walled frameless garment bag 10 which, in the embodiment illustrated, is constructed of clear, transparent polyvinyl chloride plastic and is adapted to releasably envelop a portion 12 of a longitudinally extending closet rod 14 so as to hang supported directly by and suspended therefrom. The frameless, flexible hanging garment bag 10 is comprised of opposite transversely extending flexible end walls 16 and 18, each shaped generally in the form of a pentagon. The lower portions of the end walls 16 and 18 are each of generally vertically elongated rectangular configuration, while the upper extremities each narrow generally in a triangle shape, as shown in FIG. 4.

Figure 2:
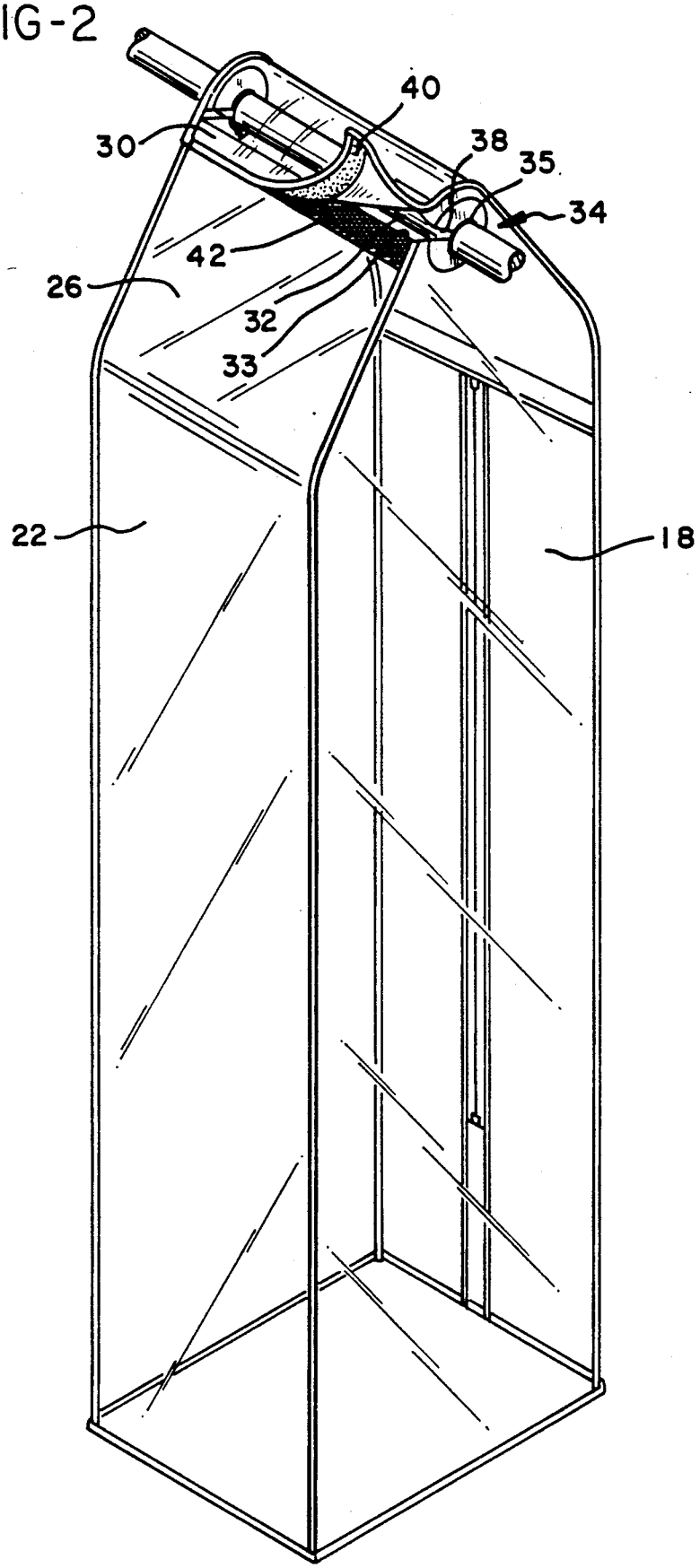
FIG. 2 is a perspective view from the rear illustrating the frameless garment bag of FIG. 1.
Figure 3:
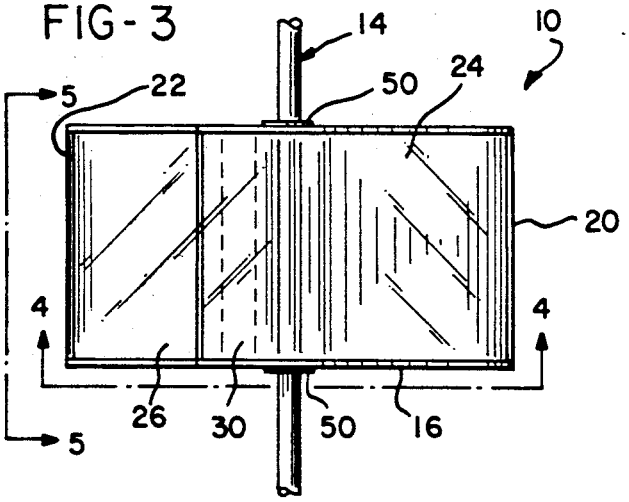
FIG. 3 is a top plan view of the garment bag of FIG. 1.

The frameless, flexible hanging garment bag 10 is also comprised of opposing flexible front and rear side walls 20 and 22, respectively, the lower portions of which are generally rectangular and the upper portions of which converge upwardly toward each other as transition sections 24 and 26, respectively. The upper, sloping transitional sections 24 and 26 of the side walls 20 and 22 are coextensive with the triangular upper regions of the opposite end walls 16 and 18. The floor 15 of the hanging garment bag 10 bounding the lower extremities of the walls 16, 18, 20 and 22 is of rectangular configuration. The transition section 24 of the side wall 20 terminates at its upper extremity in the top closure flap 30, while the transition section 26 of the opposite side wall 22 terminates at an upper edge 33. The top closure flap 30 extends over the top of the closet rod 14 above the closet rod apertures 34 and overlaps the edge 33 of the opposite side wall 22, as best illustrated in FIG. 2. The opposite end walls 16 and 18 define a pair of longitudinally aligned closet rod apertures 34 near the upper extremities of the end walls 16 and 18. The rod access opening slot 32 extends longitudinally the entire distance between the end walls 16 and 18 and transversely across the end walls 16 and 18 to intersect the closet rod apertures 34. The releasable closure flap 30 overlaps the upper edge 33 of the opposite side wall 22 proximate to the closet rod apertures 34.

Each closet rod aperture 34 includes a circular opening 35. The radial extremities of the closet rod access slot 32 form slits 38 through the structures of the end walls 16 and 18 that are narrower than the circular openings 35. The slits 38 at the closet rod apertures 34 angle upwardly and rearwardly beneath the flap 30 so that the garment bag 10 can be raised from beneath the closet rod 14 when the releasable top closure flap 30 of the side wall 20 is folded back and spread apart from the upper edge 33 of the opposite side wall 22 to fully expose the rod access opening slot 32.

Releasable top closure means in the form of mating flexible fabric hook and loop fasteners 40 and 42 are provided on the overlapping surfaces of the closure flap 30 and on the side wall 22 adjacent its upper edge 33. The interengageable top closure members 40 and 42 releasable secure the closure flap 30 to the side wall 22 so that the structure of the garment bag 10 envelops the portion 12 of the closet rod 14. The closure members 40 and 42 together respectively form first and second longitudinally extending mating contact strips.

One of the contact strips, namely the first contact strip 40 is permanently secured longitudinally along the inwardly facing margin at the upper edge of the closure flap 30 and spans the distance between the end walls 16 and 18. The contact strip 40 bears a multiplicity of minute, flexible nylon hooks projecting therefrom. The other contact strip 42, namely the second contact strip 42, is permanently secured to extend longitudinally along the upper margin of the side wall 22 adjacent the upper edge 33 thereof and likewise spans the distance between the end walls 16 and 18. The contact strip 42 faces outwardly toward the first contact strip 40 when the contact strips 40 and 42 are disposed in overlapping fashion as best depicted in FIG. 2. The second contact strip 42 bears a looped, nylon fabric pile 48 having a multiplicity of loops thereon. The contact strips 40 and 42 are disposed in juxtaposition in contact with each other when the flap 30 is arranged in overlapping fashion with the upper margin of the side wall 22. The hooks of the contact strip 40 thereupon releasably engage the loops in the pile of the contact strip 42.

Figure 6:
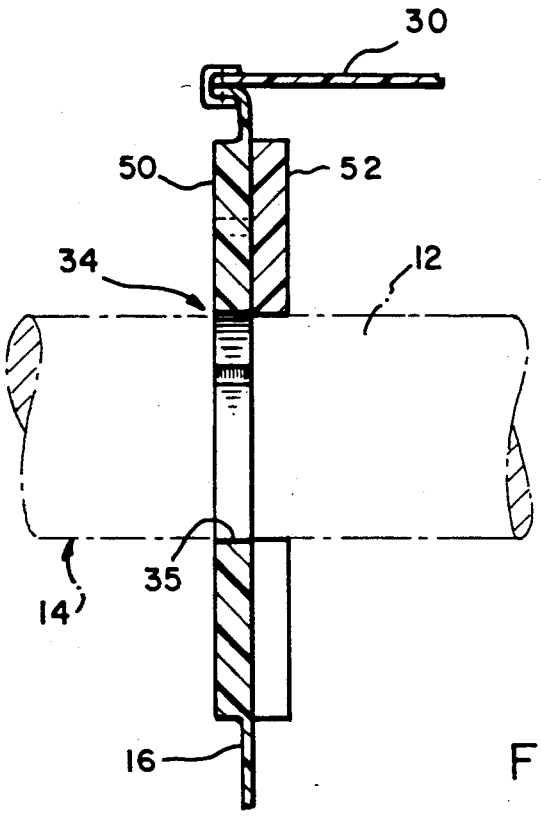
FIG. 6 is a sectional elevational detail of one of the closet rod access openings of the garment bag of FIGS. 1-5.

As illustrated in FIG. 6, the circular openings 35 of the closet rod apertures 34 in the end walls 18 and 20 are surrounded by annular reinforcing disk-shaped reinforcing areas 50. The reinforcing areas 50 are preferably formed as thickened sections of the plastic which forms the structures of the end walls 16 and 18. Each of the annular reinforcing areas 50 is split radially by the slits 38 at the extremities of the access opening slot 32. Each of the disk-shaped areas 50 is preferably about three and one-half inches in outer diameter.

Also as illustrated in FIG. 6, a pair of interior supports 52 are mounted on the encapsulated portion 14 of the closet rod 12 between the end walls 16 and 18. Each of the interior supports 52 is formed as a stiff, flat, annular plastic disk of a generally C-shaped configuration having a radial slit 38 therein and mounted on the closet rod 12 for free longitudinal movement therealong. Each split annular disk 52 is preferably about three and one-half inches in outer diameter. The disks 52 are preferably constructed of polyvinyl chloride or ABS plastic and are stiff enough to retain their disk-like shape, but flexible enough so that the portions thereof adjacent the slots therein can be spread apart to allow them to be mounted upon the closet rod 14. Each of the flat annular disks 52 is longitudinally movable into juxtaposition against a selected one of the end walls 16 and 18 in longitudinal alignment with a selected one of the circular openings 35 of the closet rod apertures 34, as depicted in FIG. 6.

The thickened sections of the end walls 16 and 18 forming the reinforcing disks 50 thereon and the interior, slidably movable disks 52 together serve to hold the upper extremities of the structures of the end walls 16 and 18 upright above the closet rod 12 so as to form a clearance thereabove between the closet rod 12 and the top flap 30. The reinforcing areas 50 and the interior supporting disks 52 create a clearance of about an inch and a half between the closet rod 12 and the top flap 30.

The frameless, flexible hanging garment bag 10 is provided with a T-shaped clothing access opening 56 in the front side wall 20 having longitudinal and vertical components. The access opening 56 includes a vertically oriented separation that divides the front side panel 20 into a pair of vertically elongated sections 58 and 60, both of elongated rectangular configuration. The vertical component of the opening 56 is releasably closable by a zipper 62.

The opening 56 also includes a longitudinally oriented separation that extends across the top of the vertically oriented sections 58 and 60 to define the transition section 24 in the side panel 20 above the vertically oriented sections 58 and 60. Releasable closure means formed of mating strips 64 and 66 of fabric hook and loop material are provided for releasably securing the longitudinally oriented component of the opening 56 in a closed or shut condition. Each of the flexible closure strips 64 bears multiplicity of tiny hooks while the other closure strip 66 includes a looped pile which is engagable by those hooks. By forming the clothing access opening 56 with both horizontal and vertical components, the hanging garment bag 10 is provided with greater ease of access for inserting and removing clothing therefrom.

To utilize the frameless garment bag 10, the C-shaped plastic disks 52 are resiliently deformed so as to embrace the closet rod 14 within the region 12 thereof. The disks 40 are preferably rotated so that the slits 38 thereof are directed vertically downwardly as depicted in FIG. 6 so as to provide maximum support above the closet rod 14.

The hanging garment bag 10 is then positioned beneath the closet rod 14 at the region 12 thereof and the closure flap 30 is pulled away from the edge 33 of the rear side wall 22 and folded back against the transition section 24. Although the contact surfaces 40 and 42 on the closure flap 30 and opposite rear side wall 22 will tend to engage each other, they can be separated by seizing a corner of the closure flap 30 and peeling it away from the upper margin of the opposite side wall 22.

The user next holds the hanging garment bag 10 by the top closure flap 30 and the upper margin of the side wall 22 and raises it vertically upwardly from directly beneath the region 12 of the closet rod 14 until the bag 10 has been raised high enough so that the circular openings 35 of the closet rod apertures 34 are at the level of the closet rod 14. The flap 30 is thereupon drawn back over the top of the portion 12 of the closet rod 14, toward the opposite side wall 22, whereupon the contact strips 40 and 42 are brought into mutual contact with each other to mutually engage each other throughout the entire distance between the end walls 16 and 18.

At this time the interior support disks are located within the confines of the garment bag 10 on the section 12 of the closet rod 14. The closet rod 14 passes completely through the structure of the garment bag 10 and emanates therefrom through the closet rod apertures 34.

The user next unzips the zipper 62 and peels the flexible closure strips 64 at the top edges of the vertically oriented sections 58 and 60 of the side wall 20 back away from the longitudinal oriented contact strip 66, thereby disengaging the mating contact strips 64 therefrom. The user then reaches into the enclosure of the hanging garment bag 10 through the clothing access opening 56 and pushes each flat annular interior supporting disk 52 toward the closet end wall 16 or 18 to which it is closest and into contact with the interior surface thereof, as illustrated in FIG. 6. The hanging garment bag 10 is then ready for use.

During use the closure members of the access opening 56 are opened in the manner previously described and clothing on hangers is inserted therethrough. The hooks of the hangers bear directly upon the closet rod 14 within the region 12 thereof without the necessity for any intermediate interior wire hanging rod, as in conventional hanging type garment bags employing wire frames. The structures of the annular reinforcing areas 50 and the supporting disks 52 are sufficiently stiff so that the hooks of the hangers bearing the clothing to be stored will readily pass between the top surface of the closet rod 14 and the undersurface of the flap 30 to allow easy insertion and withdrawal of clothing on hangers.

To remove the hanging garment bag 10 from the closet rod 14, the installation procedure is merely reversed. That is, the split annular disks 52 are drawn longitudinally along the closet rod 14 away from the end walls 16 and 18 and toward each other. The top closure flap 30 is then peeled back from the top upper margin of the opposite side wall 22, thereby disengaging the strips 40 and 42. The hanging garment bag 10 is then drawn downwardly or will fall of its own weight from the closet rod 14.

Since the flexible hanging garment bag 10 does no employ any rigid frame, it can be longitudinally compressed when it is only partially filled. That is, in a crowded closet the end walls 16 and 18 can be easily pushed toward each other to the limit allowed by the space occupied by clothing stored on hangers within the enclosure of the hanging garment bag 10. The vinyl or fabric of which the hanging garment bag 10 is constructed will easily collapse to allow the end walls 16 and 18 to be pressed toward each other but is resilient enough to return to its original shape in the absence of longitudinal pressure thereagainst.

Because the hanging garment bag 10 does not employ an internal wire frame, it can be flattened and stored for later use without danger of puncturing any of the walls 16, 18, 20 or 22. Moreover, the absence of an interior wire frame reduces to an absolute minimum the space occupied by the hanging garment bag 10 when it is packaged for sale.

Figure 7:
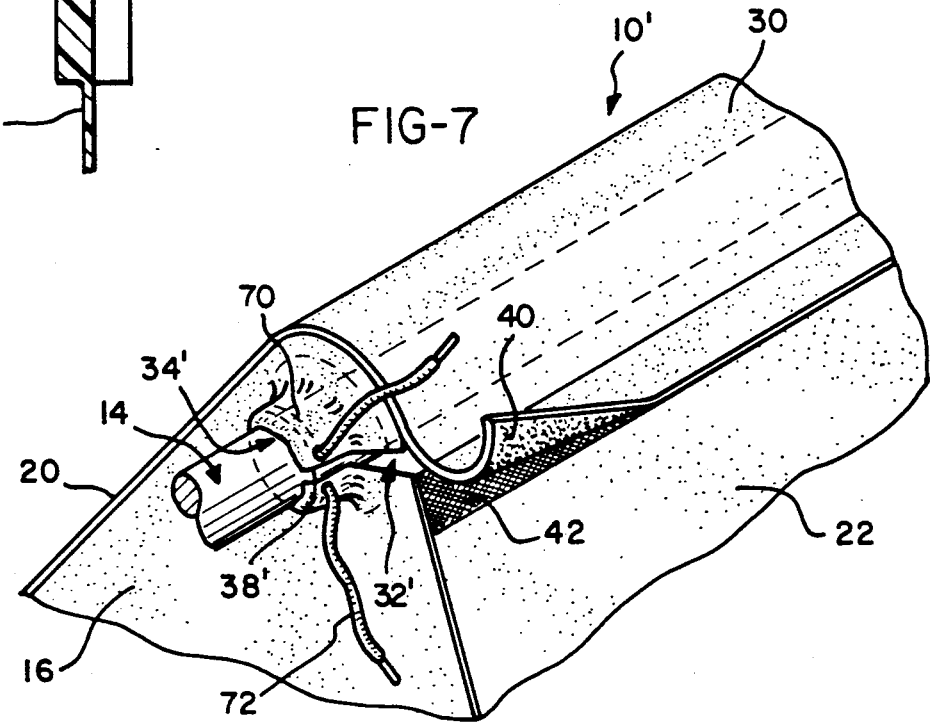
FIG. 7 is a perspective detail showing an alternative embodiment of a closet rod access opening.

FIG. 7 illustrates a modified frameless good garment bag 10' having an alternative design of closet rod apertures 34'. In the embodiment of FIG. 7 the flexible end walls 16 and 18 both form longitudinally extending sleeves 70 at the closet rod apertures 34' therein. The sleeves 70 are split longitudinally by the extremities 38' of the rod access opening slot 32', as illustrated. Some means is provided for releasably closing the longitudinal slits 38' in the sleeves 70. Specifically, each of the sleeves 70 is provided with a draw string 72 which is sewn into a hem in the end of the sleeve 70. Once the hanging garment bag 10' is installed on the closet rod 14, the ends of the draw string 72 are pulled together and tied, thereby cinching the sleeves 70 about the closet rod 14. This cinchable sleeve closure arrangement at the closet rod apertures 34' aids in isolating the interior of the garment bag 10', thereby facilitating maintenance of a moth proof environment.

Figure 8:
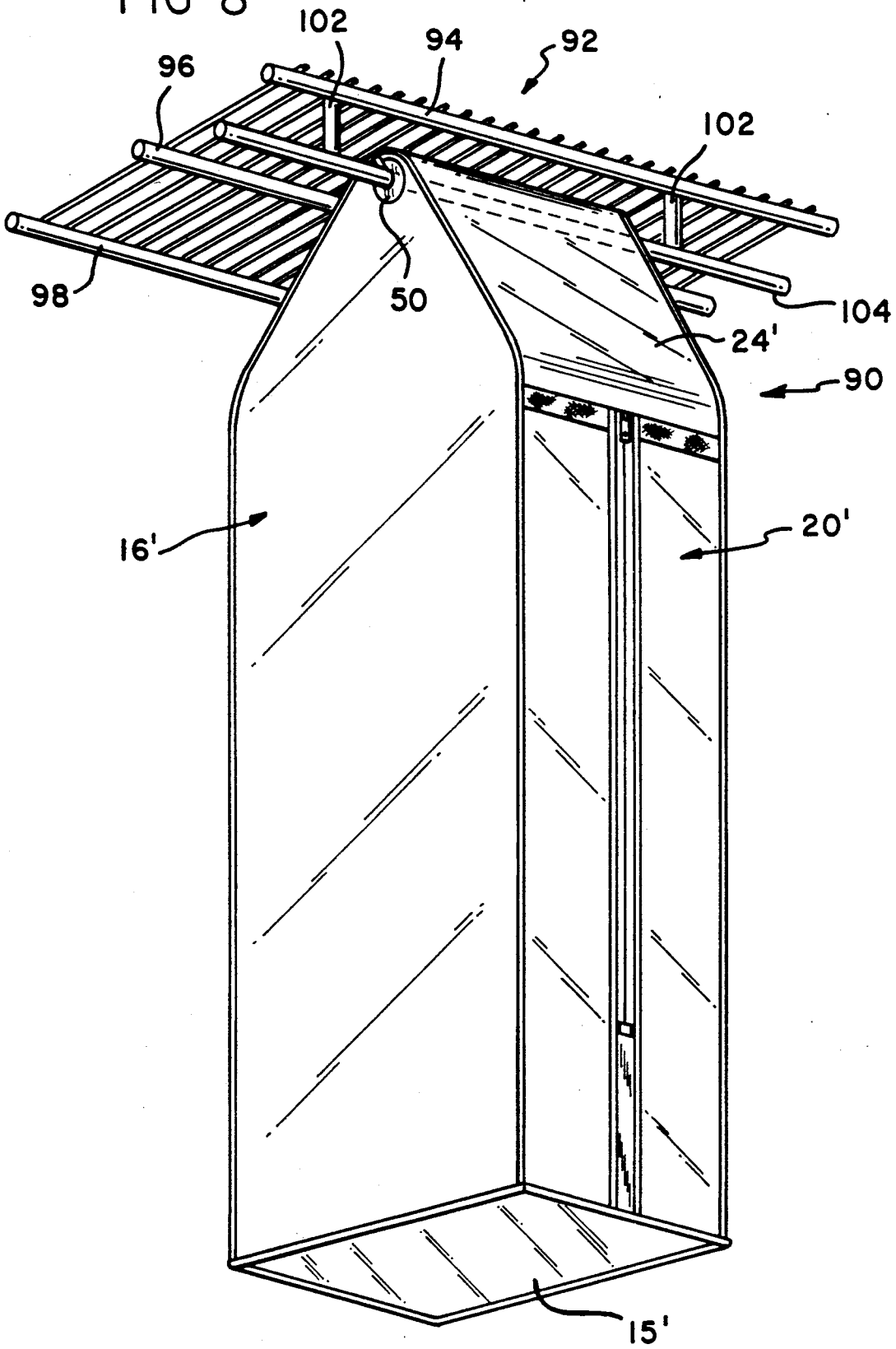
FIG. 8 is a front perspective view illustrating another alternative embodiment of the frameless hanging garment bag of the invention.

FIG. 8 illustrates a further embodiment 90 of a flexible, frameless hanging garment bag according to the invention. The hanging garment bag 90 is virtually identical to the hanging garment bag 10 in all respects, except for the size of the closet rod apertures 34 and its combination fabric and plastic construction. The hanging garment bag 90 is designed to be suspended from beneath a ventilated shelf 92. The ventilated shelf 92 is formed of three longitudinally extending primary support rods 94, 96 and 98 atop which transverse shelf rods are welded. Struts 102 which depend from the primary support rod 94 support a longitudinally extending steel closet rod 104. The entire structure of the ventilated shelf 92 is plastic coated, and the plastic sheathed closet rod 104 is approximately three eighths of an inch in diameter. Accordingly, the closet rod apertures 34 are of an diameter of between about three eighths and one-half of an inch. The fabric walls and floor 16'–22' of the garment bag 90 are formed of opaque fabric with a transparent plastic window in the transition section 24' of the front side wall 20'.

Undoubtedly, numerous variations and modifications of the invention will become readily apparent to those familiar with hanging storage devices. For example, it is sometimes more economical for the zipper and the access opening to extend much higher up the side wall 20 to eliminate the necessity of the interengageable fabric hook and loop strips 64 and 66. Also, it is not necessary for any of the structure of the hanging garment bag to be transparent, as in the embodiments illustrated. To the contrary, the hanging garment bag may be constructed of completely opaque materials. It is to be understood that the garment bag of the invention may be made in any length, as desired. For example, it may range between suit, sweater or gown length.

Accordingly, the scope of the invention should not be construed as limited to the specific embodiments illustrated and described herein, but rather is defined in the claims appended hereto.

I claim:

1. A frameless, flexible garment bag defining an enclosure and adapted to releasably receive and enclose a portion of closet rod and having a releasably closeable clothing access opening therein.

2. A frameless garment bag according to claim 1 further comprising opposite transverse, flexible end walls and opposite flexible side walls extending therebetween and wherein said flexible end walls define longitudinally aligned closet rod apertures near their upper extremities and said flexible side walls converge toward each other and terminate at a rod access opening slot that extends longitudinally the entire distance between said end walls and transversely across said end walls to intersect said closet rod apertures and at least one of said flexible side walls defines a releasable closure flap that extends across said rod access opening slot to overlap the other of said side walls proximate to said closet rod apertures, and further comprising releasable slot closure means on said releasable closure flap and on said other of said side walls for releasably securing said closure flap across said rod access opening slot and to said other of said side walls with said closet rod apertures encompassed therewithin.

3. A frameless garment bag according to claim 2 wherein said releasable slot closure means is comprised of a pair of mating contact elements, and a first of said contact elements in said pair is permanently secured to said closure flap of said one of said side walls and a second of said contact elements in said pair is permanently secured to the other of said side walls proximate to said access opening slot and facing said first contact element.

4. A frameless garment bag according to claim 3 wherein one of said first and second contact elements bears a multiplicity of minute flexible hooks projecting therefrom, and the other of said first and second contact elements bears a looped, fabric pile, and said contact elements are disposed in juxtaposition in contact with each other when said flap is arranged to overlap said other side wall with said hooks releasably engaged in said looped pile.

5. A frameless garment bag according to claim 2 wherein said closet rod apertures are formed as circular openings in said end walls surrounded by annular disk-shaped reinforcing areas on said end walls which are split radially by said access opening slot.

6. A frameless garment bag according to claim 5 further comprising a pair of interior supports for mounting on said closet rod between said end walls, each of said interior supports being formed as a flat, annular disk having a radial slot therein for mounting on said closet rod for free longitudinal movement therealong, whereby each of said flat annular disks is longitudinally movable into juxtaposition against a selected end wall in longitudinal alignment with a selected one of said circular openings.

7. A frameless garment bag according to claim 2 wherein said releasable slot closure means is comprised of first and second mutually engageable members, said first mutually engageable member being located on said releasable closure flap and said second mutually engageable member being located on said other of said side walls adjacent said access opening slot, and one of said first and second mutually engageable members has a contact surface bearing a multiplicity of outwardly projecting flexible hooks and the other of said first and second mutually engageable members has a contact surface bearing a flexible, looped pile.

8. A frameless garment bag according to claim 2 wherein one of said side walls is formed with a vertically oriented separation that longitudinally divides said one of said side walls into a pair of vertically elongated sections and said one of said side walls is also formed with a longitudinally oriented separation extending across the tops of said vertically oriented sections to define a transition section above said vertically oriented sections in said one of said side walls, and further comprising a zipper for releasably securing said vertically oriented separation shut and releasable section closure means for releasably securing said longitudinally oriented separation shut.

9. A frameless garment bag according to claim 8 wherein said releasable section closure means is comprised of first and second mutually engageable members, and one of said first and second members has a contact surface bearing a multiplicity of outwardly projecting flexible hooks and the other of said first and second members has a contact surface bearing a flexible, looped pile, and said first engageable member is permanently secured to said side wall in which said clothing access opening is defined at the lower edge of said transition section while said second engageable member has separate portions both secured across the tops of said vertically oriented sections such that said first and second mutually engageable members reside in engaged mutual juxtaposition when said zipper is closed.

10. A frameless garment bag according to claim g in which said transition section is transparent and said side walls and said end walls are elsewhere opaque.

11. A frameless garment bag according to claim 2 wherein said flexible end walls both form longitudinally extending sleeves at said closet rod apertures therein, said sleeves being split longitudinally by said rod access opening slot.

12. A frameless garment bag according to claim 11 further comprising mean for releasably closing the longitudinal splits in said sleeves.

13. A frameless garment bag according to claim 2 wherein said closet rod apertures are of a size adapted to fit snugly about a clothing rod held beneath a ventilated shelf.

14. A frameless garment bag having opposite side walls and opposite end walls defining a pair of longitudinally aligned apertures therein and a clothing rod access slot extending between said longitudinally aligned apertures in said end walls to receive a closet rod and at least one of said side walls defines a closure flap proximate to said longitudinally aligned apertures and extending longitudinally between said end walls and toward said other side wall in overlapping relationship therewith, and releasable closure means for releasably securing said closure flap over a closet rod and to said other side wall, whereby said garment bag is adapted to envelop a longitudinal section of a closet rod and hang suspended therefrom.

15. A frameless garment bag according to claim 14 wherein said releasable closure means is comprised of first and second mating contact strips and said first contact strip is permanently secured longitudinally along said closure flap and spans the distance between said end walls and said second contact strip is permanently secured longitudinally along said other side wall adjacent said clothing rod access slot facing said first contact strip, and one of said first and second contact strips bears a multiplicity of minute flexible hooks projecting therefrom, and the other of said first and second contact strips bears a looped, fabric pile, and said contact strips are positionable in mutual juxtaposition in contact with each other when said flap resides in overlapping fashion so that said hooks releasably engage said looped pile.

16. A frameless garment bag according to claim 14 wherein each of said longitudinally aligned apertures is formed with a circular opening and said clothing access slot extends radially through the structure of said end walls to said circular openings and further comprising end aperture reinforcement means in each of said end walls at each of said longitudinally aligned apertures, each of said end aperture reinforcement means including a flat annular disk having a radial slot therein.

17. A frameless garment bag according to claim 16 further comprising interior support means mounted on said section of said closet rod in longitudinally reciprocal fashion between said end walls, each of said interior support means being formed as a flat stiff annular disk having a radial opening therein, whereby each of said interior support means is movable into longitudinal alignment with a selected one of said end walls.

18. A frameless garment bag according to claim 14 wherein said releasable closure means is comprised of first and second mutually engageable members secured respectively to said flap and to said other side wall and one of said first and second engageable members has a contact surface bearing a multiplicity of outwardly projecting flexible hooks and the other of said first and second engageable members has a contact surface bearing a flexible, looped pile.

19. A frameless garment bag according to claim 14 further comprising a T-shaped clothing access opening having longitudinal and vertical components in one of said side walls, and said longitudinal component of said clothing access opening includes a releasable clothing access opening closure means formed of mating strips of flexible material, one of which bears a multiplicity of tiny plastic hooks and the other of which includes a looped pile engageable by said hooks.

20. A flexible walled frameless closet garment bag having opposite end walls and opposite side walls wherein said end walls have rod receiving apertures therein and a rod access slit is defined transversely through the structure of said end walls and longitudinally between said side walls to extend between said end apertures, and one of said side walls has a flap at its upper extremity that overlaps the other of said side walls and is releasably securable thereto and said end apertures are circular openings of a diameter to snugly receive a longitudinally extending rod of a ventilated shelf.

* * * * *